US007756287B2

(12) United States Patent
Abe

(10) Patent No.: US 7,756,287 B2
(45) Date of Patent: Jul. 13, 2010

(54) SPEAKER VIBRATING PARTS

(75) Inventor: Hirokazu Abe, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 996 days.

(21) Appl. No.: 11/507,016

(22) Filed: Aug. 21, 2006

(65) Prior Publication Data

US 2007/0041607 A1 Feb. 22, 2007

(30) Foreign Application Priority Data

Aug. 22, 2005 (JP) ..... 2005-240151

(51) Int. Cl.
*H04R 1/00* (2006.01)
*H04R 9/06* (2006.01)
*H04R 11/02* (2006.01)

(52) U.S. Cl. ..... 381/423; 381/400; 381/424; 381/433

(58) Field of Classification Search ..... 381/396, 381/398, 400, 403, 407, 412, 417, 418, 423, 381/424, 432, 433
See application file for complete search history.

(56) References Cited

U.S. PATENT DOCUMENTS

| | | | | |
|---|---|---|---|---|
| 6,343,136 | B2 * | 1/2002 | Tokusho et al. | 381/398 |
| 2002/0064294 | A1 * | 5/2002 | Tokusho et al. | 381/400 |
| 2005/0271237 | A1 * | 12/2005 | Jeong et al. | 381/396 |

FOREIGN PATENT DOCUMENTS

JP 2000-125392 A 4/2000

* cited by examiner

*Primary Examiner*—Tuan D Nguyen
(74) *Attorney, Agent, or Firm*—Arent Fox LLP

(57) ABSTRACT

A speaker vibrating part has a diaphragm body 10A and an approximately cylinder-shaped coupling portion 10B for coupling the diaphragm body 10A to a voice coil bobbin. Protruded strips 10Ba extend out from the inner periphery of the coupling portion 10B toward the center.

9 Claims, 6 Drawing Sheets

*FIRST EMBODIMENT*

FIRST EMBODIMENT

SECTION IV-IV

SECOND EMBODIMENT

SPEAKER VIBRATING PARTS

BACKGROUND OF THE INVENTION

1. Field of the Invention

This invention relates to parts constituting a vibration system of a speaker.

The present application claims priority from Japanese Application No. 2005-240151, the disclosure of which is incorporated herein by reference.

2. Description of the Related Art

FIG. 1 is a side sectional view illustrating a structure of a conventional double-cone speaker.

The conventional double-cone speaker is equipped with two diaphragms, a main cone 1 and a sub-cone 2, which are vibrating parts.

The main cone 1 is attached such that an edge damper 1B is formed integrally with the outer periphery of the main cone 1, and is secured to a speaker frame 3. The inner periphery of the main cone 1 is coupled to the outer peripheral face of a voice coil bobbin 5 which is vibrated in its axis direction by being driven by a magnetic circuit 4. The sub-cone 2 is placed inside the main cone 1 and mechanically connected to the leading end of the voice coil bobbin 5.

FIG. 1 also shows a damper 6 which is interposed between the speaker frame 3 and the voice coil bobbin 5. The damper 6 supports the voice coil bobbin 5 in such a manner as to permit it to vibrate in the axis direction.

A conventional speaker structured as described above is disclosed in JP-A-2000-125392, for example.

The main cone 1 and the sub-cone 2 which are vibrating parts for use in the double-cone speaker are typically formed of a thin resin film such as a polypropylene film, a polyimide film, a polyphenylene sulfide film or an aramid film.

In the manufacturing process of the speaker, the vibrating parts, such as the main cones 1 and the sub-cones 2, are individually nested inside one another as shown in FIG. 2 (in which the sub-cones 2 nested inside one another is illustrated), and then transferred to the assembling process of the speakers.

In the assembling process of the double-cone speakers, the nested main cones 1 need be removed one by one, and the nested sub-cones 2 need be removed one by one every time the sub-cone 2 is attached to a speaker.

At this point, however, because the main cones 1 and the sub-cones 2 are formed of a thin resin film or the like as described above, the nested main cones 1, or the nested sub-cones 2, are in close contact with each other. This gives rise to situations in which the nested cones may be not easily removed one by one, some cones may be removed together at a time or when the cones are removed one by one, the cone may be damaged. As a result, a reduction in the efficiency of assembling speakers is caused.

SUMMARY OF THE INVENTION

It is an object of the present invention to solve the problems associated with conventional speaker vibrating parts as described above and to achieve an increase in efficiency of assembling speakers.

To achieve this object, the present invention provides a speaker vibrating part for use in a speaker, having a diaphragm portion and an approximately cylinder-shaped coupling portion for coupling the diaphragm portion to a voice coil bobbin. Protrusion is formed on the inner periphery of the approximately cylinder-shaped coupling portion, and extends out from the inner wall face toward the center of the coupling portion.

In an exemplar embodiment of the present invention, a speaker vibrating part has a diaphragm portion formed of a thin resin film or a paper material, and an approximately cylinder-shaped coupling portion for coupling the diaphragm portion to a voice coil bobbin. Protrusion extends out from the inner periphery of the approximately cylinder-shaped coupling portion toward the center of the coupling portion.

The speaker vibrating parts according to the exemplar embodiment are stacked in layers in such a manner that a coupling portion of one speaker vibrating part is inserted in a diaphragm portion of another speaker vibrating part, and then transferred to the assembling process of the speakers.

At this point, the lower end of a coupling portion of an upper speaker vibrating part of the nested speaker vibrating parts, which is inserted in a diaphragm portion of the lower speaker vibrating part, adjoins the protrusion formed on the inner peripheral face of the coupling portion of the lower speaker vibrating part, so that the upper speaker vibrating part is inhibited from going beyond the adjoining point and entering the coupling portion of the lower speaker vibrating part.

Accordingly, an empty space is created between upper and lower speaker vibrating parts of the nested speaker vibrating parts, so that the speaker vibrating parts nested together are separated from each other as a whole. In consequence, the nested speaker vibrating parts are not engaged in each other or do not come into close contact with each other. Thus, when the speaker vibrating parts nested together are removed one by one for assembling the speakers, the removal of the speaker vibrating part is made much easier, leading to a significant increase in productivity and the prevention of the speaker vibrating parts from being damaged and deformed.

In the speaker vibrating part of the embodiment, the protrusions are formed in plurality at regular angular intervals along the inner periphery of the coupling portion, or have a protruded strip shape extending parallel to an axis direction of the coupling portion, or alternatively are formed throughout the overall inner periphery of the coupling portion. In this way, the speaker vibrating parts are further reliably prevented from coming into close contact with or being engaged in each other when they are nested.

In the speaker vibrating part of the embodiment, when the speaker vibrating part is a sub-cone for use in a double-cone speaker or when the speaker vibrating part is a main cone for use in a double-cone speaker, a significant improvement in efficiency of assembling the double cone speakers is possible.

The speaker vibrating part of the embodiment is applicable to any case of the cases when the diaphragm portion and the coupling portion are formed of either a resin film or a paper material and integrally with each other, when a dust cap is formed integrally with the coupling portion and when the dust cap is formed independently of the coupling portion.

These and other objects and features of the present invention will become more apparent from the following detailed description with reference to the accompanying drawings.

DETAILED DESCRIPTION OF THE PREFERRED EMBODIMENTS

First Embodiment

Figure 1:
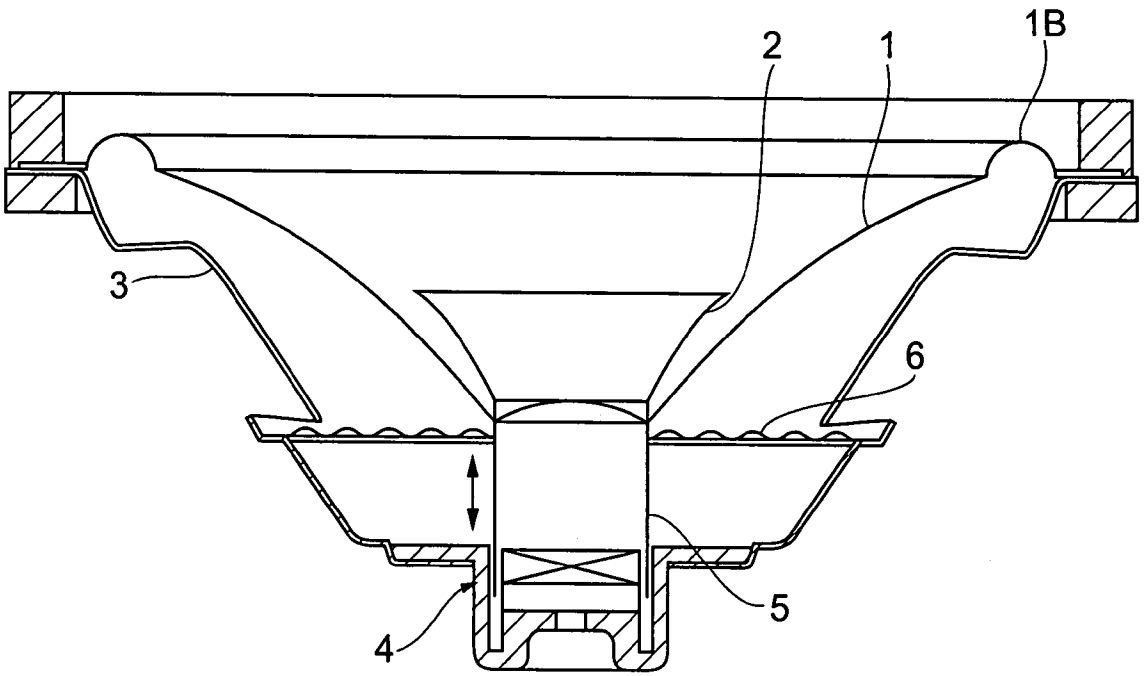
Fig.1 RELATED ART
FIG. 1 is a side sectional view illustrating the structure of a conventional double-cone speaker.
Figure 2:
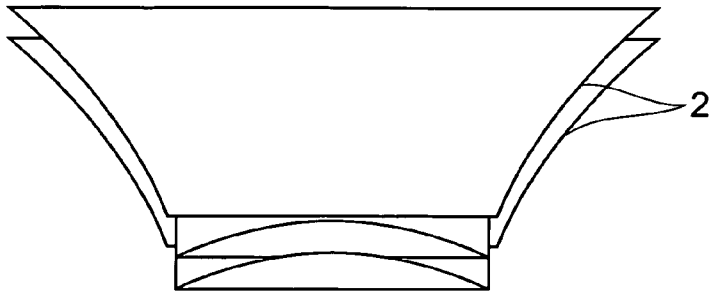
FIG. 2 is a diagram illustrating the state when conventional vibrating parts for use in a speaker are nested inside one another.
Figure 3:
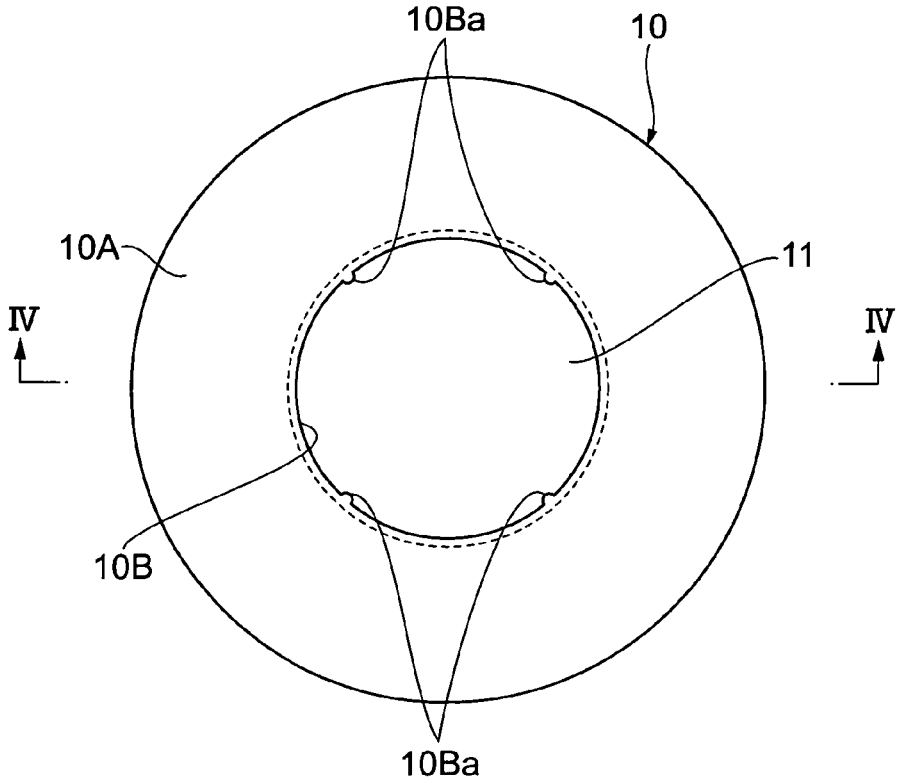
FIG. 3 is a plane view illustrating a first embodiment according to the present invention.
Figure 4:
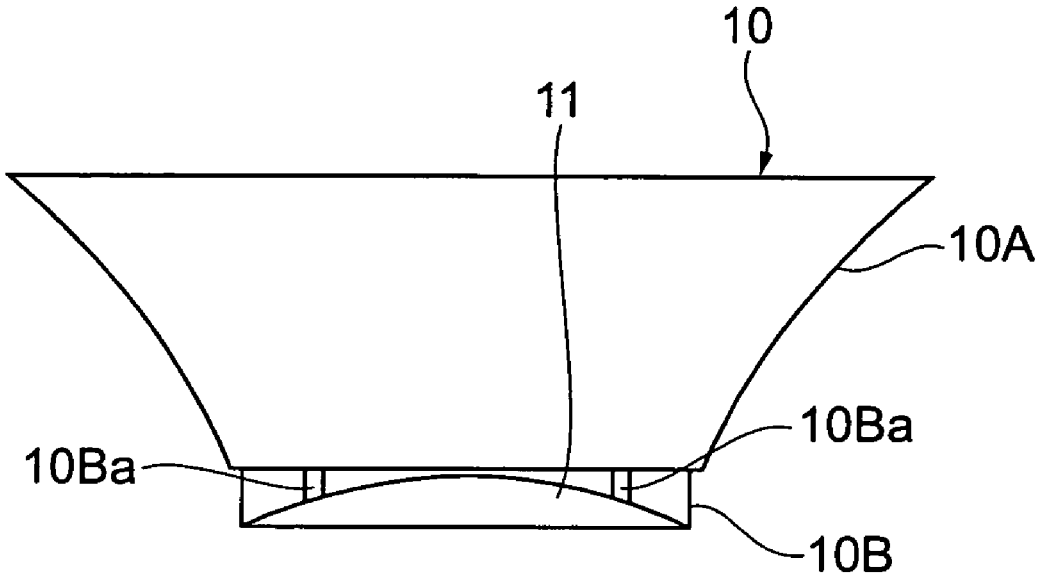
FIG. 4 is a sectional view taken along the IV-IV line in FIG. 3.
Figure 5:
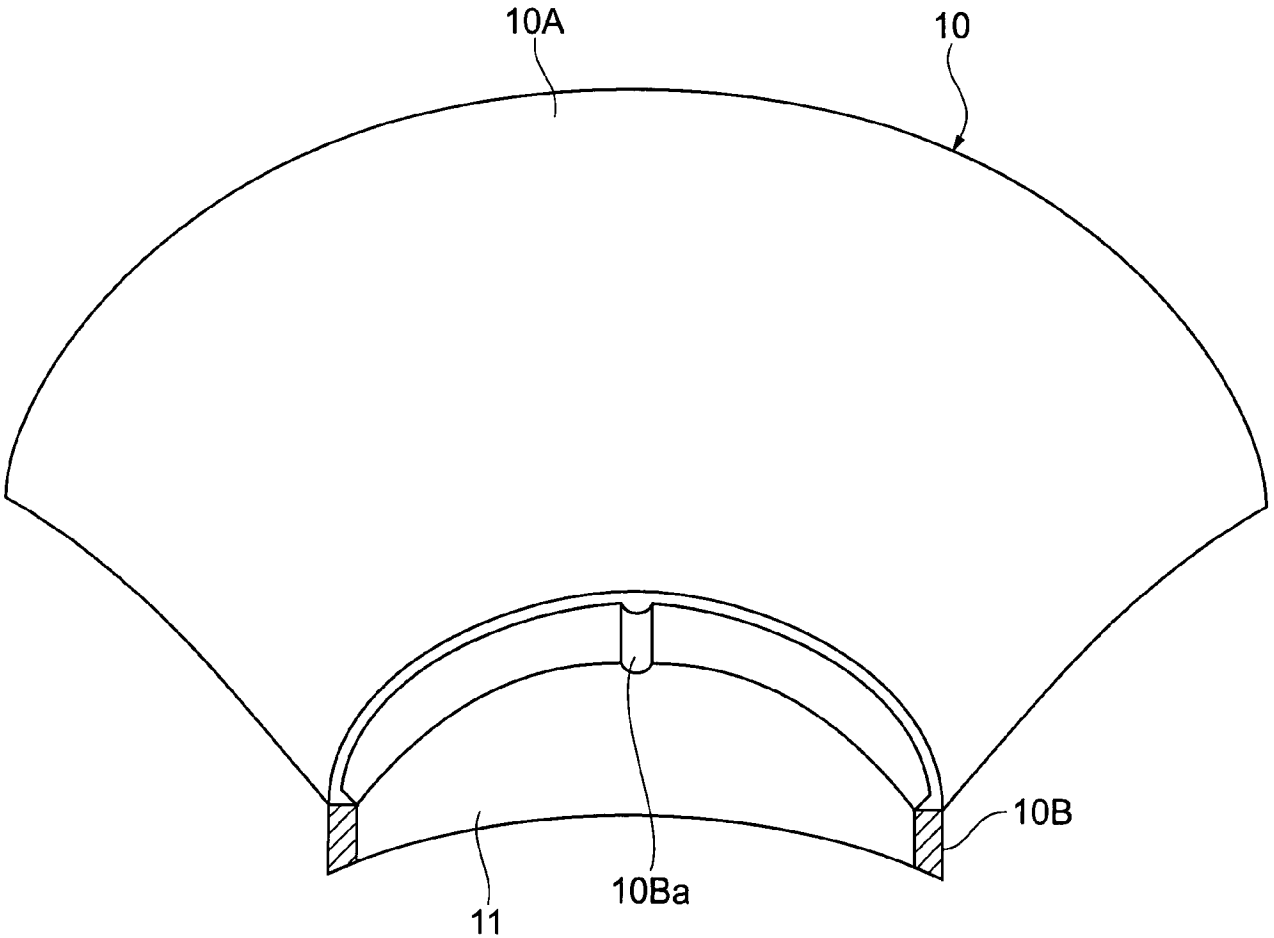
FIG. 5 is a perspective view of cross-section of a vibrating part for use in a speaker according to the first embodiment.

FIGS. 3 to 5 illustrate a first embodiment according to the present invention.

Speaker vibrating parts for use in a speaker according to the first embodiment are applicable to either a main cone or a sub-cone which constitute the double-cone speaker. The first embodiment describes using a sub-cone as an example.

FIG. 3 is a plane view of a sub-cone according to the first embodiment. FIG. 4 is a sectional view taken along the IV-IV line in FIG. 3. FIG. 5 is a perspective view of the sub-cone of the first embodiment being cut away in half.

In FIGS. 3 to 5, the sub-cone 10 is formed of a paper material or a thin resin film such as a polypropylene film, a polyimide film, a polyphenylene sulfide film or an aramid film. The sub-cone 10 is made up of an approximately bowl-shaped diaphragm body 10A and an approximately hollow-cylinder-shaped coupling portion 10B which is formed integrally with the bottom edge of the diaphragm body 10A.

The sub-cone 10 includes a dome-shaped dust cap 11 which is placed such that the top of the dome shape of the dust cap 11 is positioned inside the coupling portion 10B and the circumferential end of the dome shape is formed integrally with the end of the coupling portion 10B opposite the other end close to the vibration body 10A.

Protruded strips 10Ba are formed integrally with the inner peripheral face of the coupling portion 10B of the sub-cone 10, and are spaced at regularly angular intervals in the circumferential direction (the four protruded strips 10Ba are provided in the example shown in FIGS. 3 to 5). Each of the protruded strips 10Ba extends parallel to the axis direction of the sub-cone 10 and extends out from the inner wall of the coupling portion 10B toward the center of the circle of the coupling portion 10B.

Figure 6:
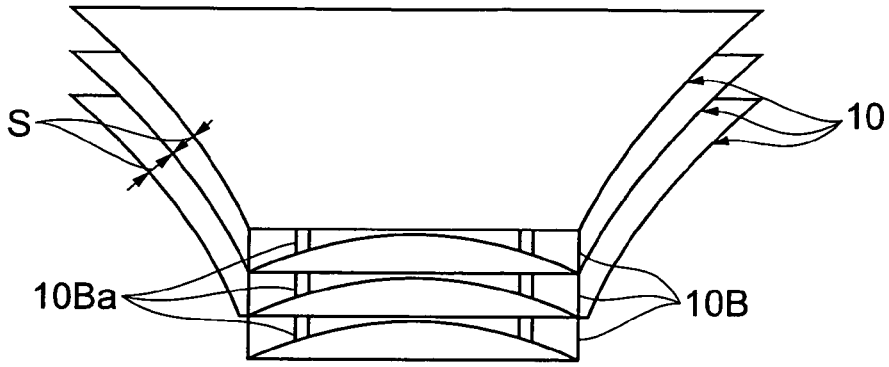
FIG. 6 is a diagram illustrating the state when the vibrating parts for use in a speaker according to the first embodiment are nested inside one another.

When the above sub-cones 10 are nested inside one another, as shown in FIG. 6, the lower end of a coupling portion 10B of an upper sub-cone 10, which is inserted in a diaphragm body 10A of the lower sub-cone 10, adjoins the upper ends of protruded strips 10Ba formed on the inner peripheral face of a coupling portion 10B of the lower sub-cone 10, so that the upper sub-cone 10 is inhibited from going beyond the upper ends and entering the coupling portion 10B of the lower sub-cone 10.

As a result, an empty space S is created between upper and lower sub-cones 10, so that the sub-cones 10 nested together are separated from each other as a whole, which thus avoiding a situation, as conventionally occurring, in which the nested sub-cones are engaged in each other or come into close contact with each other.

Accordingly, when the sub-cones 10 nested together are removed one by one during the process of assembling the speakers, the space S created between the vertically adjacent sub-cones 10 significantly facilitates removal of a sub-cone 10 from the nested sub-cones 10, and eliminates the possibility that several sub-cones 10 may be removed at a time or the sub-cone 10 may be damaged when the sub-cones 10 are removed one by one, as happens conventionally.

In another possible method for making it easy to remove the nested sub-cones one by one, the material for forming the sub-cone may be changed to make the sub-cone not be easily deformed. In this case, however, various disadvantages arise. For example, the performance of this sub-cone cannot reaches a desired level of the performance as vibrating parts for use in a speaker, and the costs are increased. By contrast, in the case of the sub-cone 10, addition of a minimal and simple process having no effect on the speaker performance enables a significant improvement of the efficiency of assembling the speakers, leading to a stable supply of speaker products.

The foregoing describes the example of a plurality of protruded strips 10Ba being formed on the inner peripheral face of the coupling portion 10B. However, the thickness of the material of the coupling portion may be increased throughout its circumference (in other words, a protruded strip may be formed on the overall inner peripheral face of the coupling portion).

However, the formation of a plurality of the protruded strips 10Ba on the inner peripheral face of the coupling portion 10B as described earlier facilitates removal of the sub-cones one by one, even if the peripheral wall of a coupling portion is not parallel to the axis direction of a sub-cone and the end of the coupling portion connecting to a diaphragm body is increased in diameter, and the coupling portion of an upper sub-cone is fitted into the coupling portion of the lower sub-cone when the sub-cones are nested inside one another. This is because an empty space is created between the coupling portions which are vertically adjacent to each other by the protruded strips which are formed on the inner peripheral face of the coupling portion of the lower sub-cone.

The forgoing describes an embodiment when the present invention is applied to a sub-cone used in a double-cone speaker as described earlier. However, when a main cone has an approximately cylinder-shaped coupling portion formed on the bottom end, the main cone can be structured as in the case of the sub-cone, thereby facilitating assembly of double-cone speakers.

Second Embodiment

Figure 7:
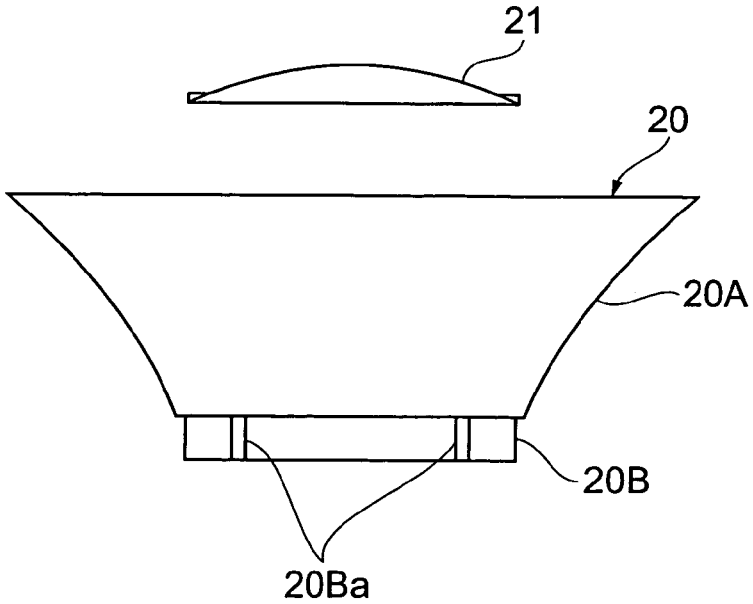
FIG. 7 is a plane view illustrating a second embodiment of the present invention.

FIG. 7 illustrates a second embodiment according to the present invention.

The aforementioned first embodiment describes the sub-cone with the dust cap formed integrally therewith. In the second embodiment, a sub cone and a dust cap are formed independently of each other.

In FIG. 7, a sub-cone 20 which is a vibrating part used in a double-cone speaker is formed independently of a dust cap 21. The sub-cone 20 is formed of a paper material or a thin resin film such as a polypropylene film, a polyimide film, a polyphenylene sulfide film or an aramid film. The sub-cone 20 is made up of an approximately bowl-shaped diaphragm body 20A and an approximately hollow-cylinder-shaped coupling portion 20B which is formed integrally with the bottom edge of the diaphragm body 20A.

Protruded strips 20Ba are formed integrally with the inner peripheral face of the coupling portion 20B of the sub-cone 20, and are spaced at regularly angular intervals in the circumferential direction (the four protruded strips 20Ba are provided in the example shown in FIG. 7). Each of the protruded strips 20Ba extends parallel to the axis direction of the sub-cone 20 and extends out from the inner periphery face of the coupling portion 20B toward the center of the circle of the coupling portion 20B.

Figure 8:
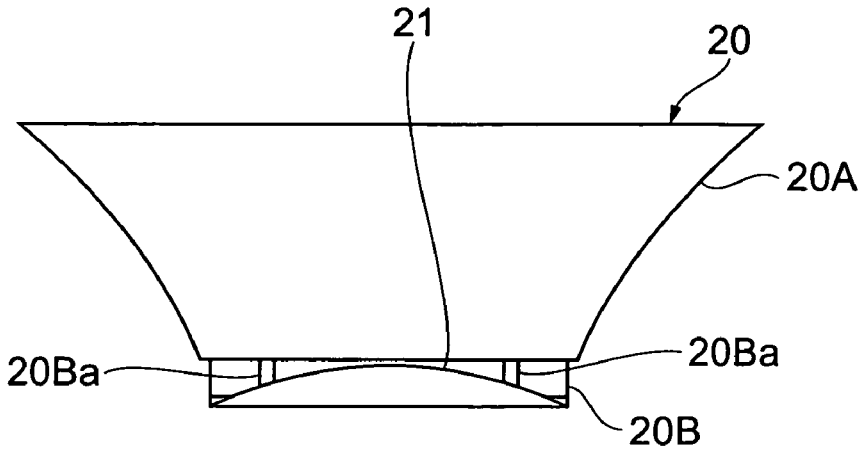
FIG. 8 is a side sectional view illustrating a sub-cone and a dust cap which are coupled to each other in the second embodiment.

A dome-shaped dust cap 21 is formed separately from the sub-cone 20. Then, as shown in FIG. 8, the dust cap 21 is put in the coupling portion 20B, and then the outer peripheral edge of the dust cap 21 is engaged with the inner peripheral face of the coupling portion 20B, so that the dust cap 21 is coupled to the sub-cone 20.

Figure 9:
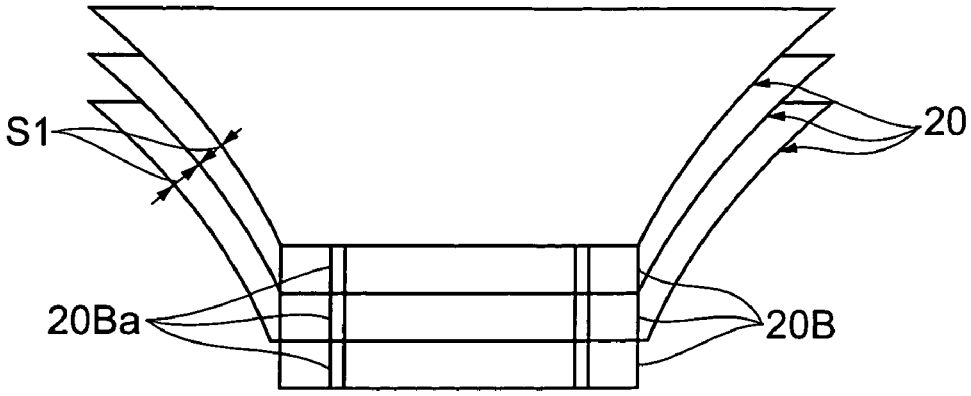
FIG. 9 is a diagram illustrating the state when the vibrating parts for use in a speaker according to the second embodiment are nested inside one another.

When the sub-cones 20 without the dust caps 21 are nested inside one another, as shown in FIG. 9, the lower end of a coupling portion 20B of an upper sub-cone 20, which is inserted in a diaphragm body 20A of the lower sub-cone 20, adjoins the upper ends of protruded strips 20Ba formed on the inner peripheral face of a coupling portion 20B of the lower sub-cone 20, so that the upper sub-cone 20 is inhibited from beyond the adjoining point and entering the coupling portion 20B of the lower sub-cone 20.

As a result, an empty space S1 is created between upper and lower sub-cones 20, so that the sub-cones 20 nested together are separated from each other as a whole, which thus avoiding a situation, as conventionally occurring, in which the nested sub-cones are engaged in each other or come into close contact with each other.

Accordingly, when the sub-cones 20 nested together are removed one by one during the process of assembling the speakers, the space S1 created between the vertically adjacent sub-cones 20 significantly facilitates removal of a sub-cone 20 from the nested sub-cones 20, and eliminates the possibility that several sub-cones 20 may be removed at a time or the sub-cone 20 may be damaged when the sub-cones 20 are removed one by one, as happens conventionally.

In another possible method for making it easy to remove the nested sub-cones one by one, the material for forming the sub-cone may be changed to make the sub-cone not be easily deformed. In this case, however, various disadvantages arise. For example, the performance of this sub-cone cannot reaches a desired level of the performance as vibrating parts for use in a speaker, and the costs are increased. By contrast, in the case of the sub-cone 20, addition of a minimal and simple process having no effect on the speaker performance enables a significant improvement of the efficiency of assembling the speakers, leading to a stable supply of speaker products.

Even when the sub-cones 20 with the dust caps 21 respectively attached there to are nested inside one another, the space is created between the vertically adjacent sub-cones 20 by means of the protruded strips 20Ba. This is because, as shown in FIG. 8, the outer peripheral edge of the dust cap 21 is engaged with the outer end of the coupling portion 20B of the sub-cone 20, so that the inner ends of the protruded strips 20Ba are exposed to view through the diaphragm body 20A. As a result, the nested sub-cones 20 are easily removed one by one in the process of assembling the speakers.

The foregoing describes the example of a plurality of protruded strips 20Ba being formed on the inner peripheral face of the coupling portion 20B. However, the thickness of the material of the coupling portion may be increased throughout its circumference (in other words, a protruded strip may be formed on the overall inner peripheral face of the coupling portion).

However, the formation of a plurality of the protruded strips 20Ba on the inner peripheral face of the coupling portion 20B as described earlier facilitates removal of the sub-cones one by one, even if the peripheral wall of a coupling portion is not parallel to the axis direction of a sub-cone and the end of the coupling portion connecting to a diaphragm body is increased in diameter, and the coupling portion of an upper sub-cone is fitted into the coupling portion of the lower sub-cone when the sub-cones are nested inside one another. This is because an empty space is created between the coupling portions which are vertically adjacent to each other by the protruded strips which are formed on the inner peripheral face of the coupling portion of the lower sub-cone.

The forgoing describes an embodiment when the present invention is applied to a sub-cone used in a double-cone speaker as described earlier. However, when a main cone has an approximately cylinder-shaped coupling portion formed on the bottom end, the main cone can be structured as in the case of the sub-cone, thereby facilitating assembly of double-cone speakers.

The vibrating part for use in a speaker described in the first and second embodiments has a diaphragm portion formed of a thin resin film or a paper material, and an approximately cylinder-shaped coupling portion for coupling the diaphragm portion to a voice coil bobbin. Protrusion is formed on the inner periphery of the approximately cylinder-shaped coupling portion and extends out toward the center thereof. In consequence, a plurality of the speaker vibrating parts are stacked in layers in such a manner that a coupling portion of one speaker vibrating part is inserted in a diaphragm portion of another speaker vibrating part. Then, when the speaker vibrating parts thus nested inside one another are transferred to the assembling process of the speakers, the lower end of a coupling portion of an upper speaker vibrating part, which is inserted in a diaphragm portion of the lower speaker vibrating part, adjoins the protrusions formed on the inner peripheral face of the coupling portion of the lower speaker vibrating part, so that the upper speaker vibrating part is inhibited from going beyond the adjoining point and entering the coupling portion of the lower speaker vibrating part.

Accordingly, an empty space is created between upper and lower speaker vibrating parts of the nested speaker vibrating parts, so that the speaker vibrating parts nested together are separated from each other as a whole. In consequence, the nested speaker vibrating parts are not engaged in each other or do not come into close contact with each other. Thus, when the speaker vibrating parts nested together are removed one by one for assembling the speakers, the removal of the speaker vibrating part is made much easier, leading to a significant increase in productivity and the prevention of speaker vibrating parts from being damaged and deformed.

The terms and description used herein are set forth by way of illustration only and are not meant as limitations. Those skilled in the art will recognize that numerous variations are possible within the spirit and scope of the invention as defined in the following claims.

What is claimed is:

1. A speaker vibrating part for use in a speaker comprising:

a diaphragm portion; and an approximately cylinder-shaped coupling portion for coupling the diaphragm portion to a voice coil bobbin, wherein protrusion is formed on an inner periphery of the approximately cylinder-shaped coupling portion and extends out from an inner wall face of the coupling portion toward a center of the coupling portion.

2. A speaker vibrating part according to claim 1, wherein the protrusions are formed in plurality and spaced at regular angular intervals along the inner periphery of the coupling portion.

3. A speaker vibrating part according to claim 2, wherein each of the protrusions has a protruded strip shape extending parallel to an axis direction of the coupling portion.

4. A speaker vibrating part according to claim 1, wherein the protrusions are formed throughout the overall inner periphery of the coupling portion.

5. A speaker vibrating part according to claim 1, wherein the speaker vibrating part is a sub-cone for use in a double-cone speaker.

6. A speaker vibrating part according to claim 1, wherein the speaker vibrating part is a main cone for use in a double-cone speaker.

7. A speaker vibrating part according to claim 1, wherein the diaphragm portion and the coupling portion are formed of either a resin film or a paper material and formed integrally with each other.

8. A speaker vibrating part according to claim 1, further comprising a dust cap, wherein the dust cap is formed integrally with the coupling portion.

9. A speaker vibrating part according to claim 1, further comprising a dust cap, wherein the dust cap is formed independently of the coupling portion.

* * * * *